US006058568A

United States Patent [19]

Pasini et al.

[11] Patent Number: 6,058,568

[45] Date of Patent: May 9, 2000

[54] FIBER-GUIDING WEDGE FOR CARDERS

[75] Inventors: Giovanni Battista Pasini; Silvano Patelli, both of Palazzolo Sull'Oglio, Italy

[73] Assignee: Fratelli Marzoli & C SpA, Bergamo, Italy

[21] Appl. No.: 09/173,594

[22] Filed: Oct. 15, 1998

[30] Foreign Application Priority Data

Oct. 16, 1997 [IT] Italy ..... MI97A2338

[51] Int. Cl.[7] ..... D01G 15/00

[52] U.S. Cl. ..... 19/98; 19/105; 19/205

[58] Field of Search ..... 19/98, 99, 104, 19/105, 106 R, 107, 108, 109, 110, 204, 205

[56] References Cited

U.S. PATENT DOCUMENTS 3,315,320 4/1967 Bass, Jr. et al. .
4,064,598 12/1977 Katoh et al. .
4,379,357 4/1983 Beneke et al. ..... 19/105
4,972,551 11/1990 Fehrer ..... 19/99
5,442,836 8/1995 Fehrer ..... 19/99

FOREIGN PATENT DOCUMENTS 76 629 3/1962 France .
2289693 11/1995 United Kingdom .

*Primary Examiner*—John J. Calvert
*Assistant Examiner*—Gary L. Welch
*Attorney, Agent, or Firm*—Kramer Levin Naftalis & Frankel

[57] ABSTRACT

A flat-head carder, equipped in the tangential area between the main drum and briseur with a fiber-guiding wedge fitted with a discharge opening provided at a tangential direction to the surface of the drum and prior to their tangency, connected to an aspirating nozzle.

11 Claims, 4 Drawing Sheets

26
25
24
15
20
32
27
23
31
28
16
17
42
41
50
21
18
40
29

FIBER-GUIDING WEDGE FOR CARDERS

This invention refers to flat-head carders, in which the fibrous material is processed in a thin layer by a series of surfaces equipped with multiple prongs of various shape, inclination and stiffness kept in a relative motion to each other, whereby the fibrous material is split up into individual fibers, while smaller dirt particles—such as droppings and snarls—are eliminated and the fibers are intermingled to form a belt of untwisted fibers, to be conveyed to further processing stages.

DETAILED DESCRIPTION OF THE DRAWINGS

Figure 1:
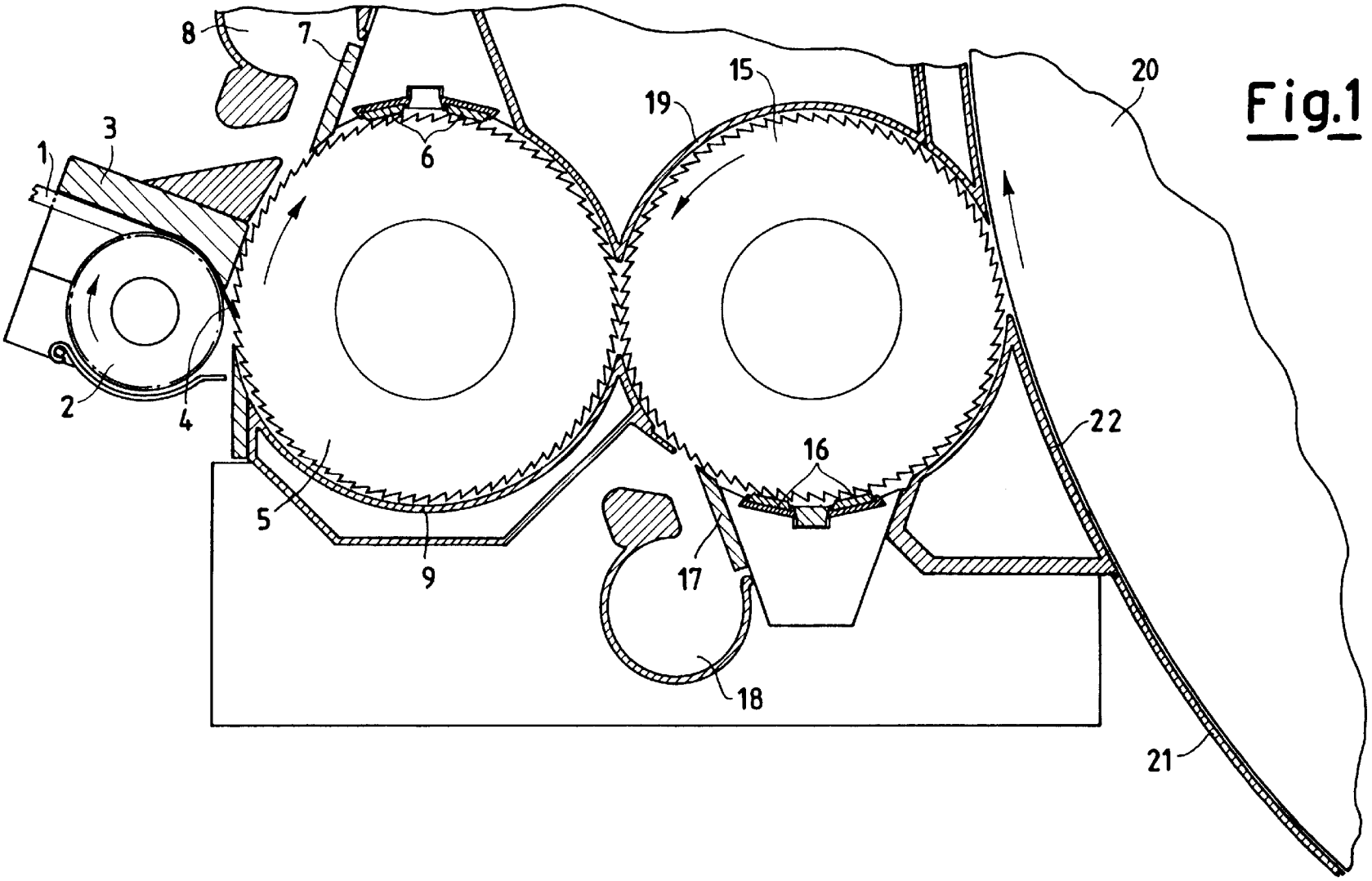
FIG. 1 is a side schematic view of a carding arrangement comprising the fiber guiding wedge according to the present invention.

In order to evidence the technical problems involved in the carding operation and dealt-with by this invention, the flat-head carding process will be summarily described with reference to the diagram shown in FIG. 1.

The raw material 1, constituted by flocks of fibers gathered in the form of a small mat is fed to the machine by a feeding roller 2 which presses and controls it against the board 3 and supplies it in the form of a panel 4 to the splitting cylinder 5, usually known as "briseur" or feed roll. This cylinder is fitted with a gasket or prongs tilted in the direction of rotation and moved at a considerable rotating speed. The fiber panel 4 is thus roughly combed and distributed over the opening cylinder in a layer thinner than the original layer in 1. Along its direction of clockwise rotation the fiber layer encounters trimmed segments 6 and knives 7 designed to remove its impurities. These impurities are aspirated by suction nozzles 8 set up opposite the face of the knife 7 on the outside of the briseur 5. The knives 7 and trimmed segments 6 are mounted on supports and equipped with regulating devices, not shown in the figure for simplicity, designed to position them with precision in relation to the trimming of the teeth of the briseur cylinder, depending on the nature and the condition of the fibers about to be processed.

The embodiment of FIG. 1 shows a second splitting cylinder or briseur 15, also equipped with a trimming and moved at a considerable rotating speed. Its peripheral velocity is substantially higher than that of the first cylinder, while the teeth of its trimming remove the fibers from the first briseur. The second briseur has an indicative peripheral speed 20–70%, and preferably 40–55% higher than that of the first briseur.

The fibers are further combed and distributed on the second briseur 15 in a layer thinner than that on the briseur 5. Along its counterclockwise rotation the fiber layer encounters other trimmed segments 16, knives 17 and aspirating nozzles 18, similar to those of the first briseur.

The two briseurs 5 and 15 are surrounded, in the remaining parts of their circumference, by restraining plates 9 and 19 which hold the fibers in contact with their trimmings, except at the points of their interaction with the organs described above, and at the feeding and discharge points. The second briseur then feeds its fibers to the following main carding drum 20.

The main carding drum 20 is generally driven at a lower rotating speed than that of the briseur 15, but at a higher peripheral velocity, due to its much greater diameter. The prongs of the drum 20 are also tilted in the direction of motion and remove, at their closest generatrix profiles between the briseur 15 and the drum 20, the fibers from the trimmed surface of the cylinder 15. The drum's peripheral velocity is in the range of 1,000 and 2,500 m/min, i.e. 20–50% higher than that of the briseur feeding the fibers.

The so-called fixed and moving flat-heads, which are not shown in the figure for simplicity, are arranged along the circumference of the drum 20. These flat-heads interact with the drum trimming to card the fibers fed by the briseurs, which are processed on the carding drum and are removed from the carder by discharging and detaching cylinders, also not shown in the figure for the sake of simplicity.

In the traditional carders the drum 20 is surrounded by a grid in the lower portion of the carder. As a result of the centrifugal force and turbulence induced by the grill, the impurities are separated from the fiber layer being processed, distributed over the trimming of the drum 20, and fall down through the grill to accumulate beneath the same for periodical removal. A part of these impurities, particularly of the finer sort, is inevitably dispersed into the environment.

In the carders of the latest design the drum 20 is equipped in its lower portion with one or two units for the removal of impurities, composed of knives and locally aspirating nozzles, not shown in the figure but similar to the knives 7, 17 and nozzles 8, 18 of the splitting briseurs. In the remainder of the lower half circle of the carder the rotating drum 20 is contained by a cylindrical restricting plate 21 set at a very short distance from the drum's carding trimming, which retains the fibers on the carder trimming, while opposing the centrifugal component of the forces impinging upon it as a result of the rotation of the carder drum. This short-distance containment of the drum achieves a better control over the discharge of impurities, prevents their uncontrolled dispersion into the environment and allows operating at high carding speeds, but generates in the annular interspace between the drum 20 and the plate 21 a considerable current of air entrained at high velocity, which causes, especially at the points of cross-sectional changes of said annular interspace, certain turbulent effects generating considerable problems, especially in their tangential area where the fibers are transferred from the briseur 15 to the drum 20, which holds a fiber guiding wedge 22 equipped with curved and hollow areas fitting the surfaces of the cylinders of the briseur 15 and of the drum 20.

This turbulence is a hindrance to the proper transfer of the fibers being processed from the briseur trimmer to the drum 20, and to their uniform distribution on its trimmer, thus causing undesirable losses and detachments of fibers.

More specifically, this invention refers to a fiber-guiding wedge of new design, capable of reducing the effects of air turbulence generated by the motion of these organs, and of allowing the proper transfer of the fibers between the cylinders, as well as their uniform distribution over the trimmer.

In its main features, the wedge includes, for example, a face provided with a discharge opening shaped in the body of the wedge with a smoothly fitting tangential profile with a cross-section increasing in the direction toward an aspirating nozzle.

In order to illustrate the characteristics and advantages of this invention in a more evident manner, it will for exemplifying and non-limiting purposes be described with reference to some typical embodiments shown in the FIGS. 2 and 3.

Figure 2:
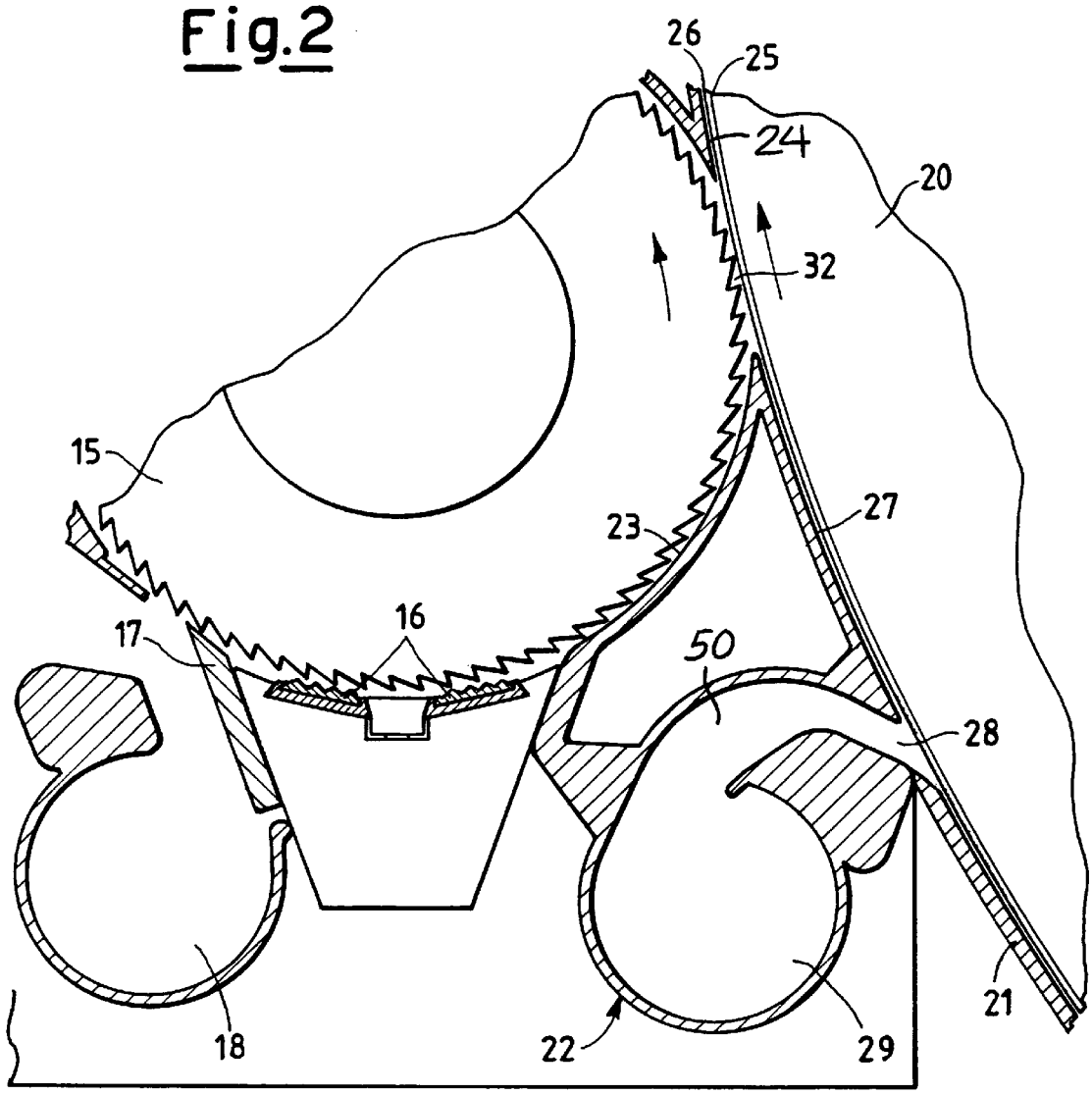
FIG. 2 is an embodiment of the fiber guiding wedge of FIG. 1 comprising a tangential opening adjacent the carding cylinder with an increasing cross sectional area.

The embodiment of FIG. 2 shows an enlargement of the transfer area of the fibers from the second briseur 15 to the drum 20. The combed fibers distributed by the second briseur 15 are first brought in contact with the knife 17 discharging to the aspirating nozzle 18, then carded by the fixed carding elements 16 and finally carried to their discharge by the left-side hollow face 23 of the wedge 22 leading to the drum 20. At their confluence between the briseur 15 and the drum, the fibers pass from the briseur trimming to the drum trimming 24, whose base and peak levels 25, 26 are shown. These trimmer prongs have a peripheral velocity much higher than that of the briseur and remove the fiber layer transported and distributed on the latter. As already mentioned, the distance between the prongs at the level 26 and the plate 21 is very small, indicatively in the range of 0.5–3.5 mm.

According to this invention, the hollow face which surrounds the drum 20 and precedes the tangent area between the briseur 15 and the drum 20 where the transfer of fibers occurs, meaning the plate 21 or preferably the face 27 of the same wedge body 22 is fitted with an opening 28 to provide a tangential discharge for the air crossing said annular interspace between the plate 21 and the drum 20.

This opening is shaped in the body of the wedge 22 so as to have a smoothly fitting tangential profile with an increasing cross sectional area in the direction toward the aspirating nozzle 29. This aspirating nozzle is preferably constituted by an aspirating channel 50 crossing the entire length of the carder and held under negative pressure. The opening 28 allows discharging part of the entrained air, thus freeing the remainder of the annular interspace from any turbulent effects up to the point of confluence of the fibers, and thereby eventually also allowing the removal of any impurities contained in the discharged air. According to a preferred embodiment of the invention, the distance of this opening 28 from the tip of the wedge is held in the range of 50–100 mm, and preferably in the range of 80–90 mm.

Negative pressure values of the nozzle 29 in the range of 20–60 mm $H_2O$ have proved satisfactory for discharging the air with a significant reduction of its turbulent effects.

Figure 3:
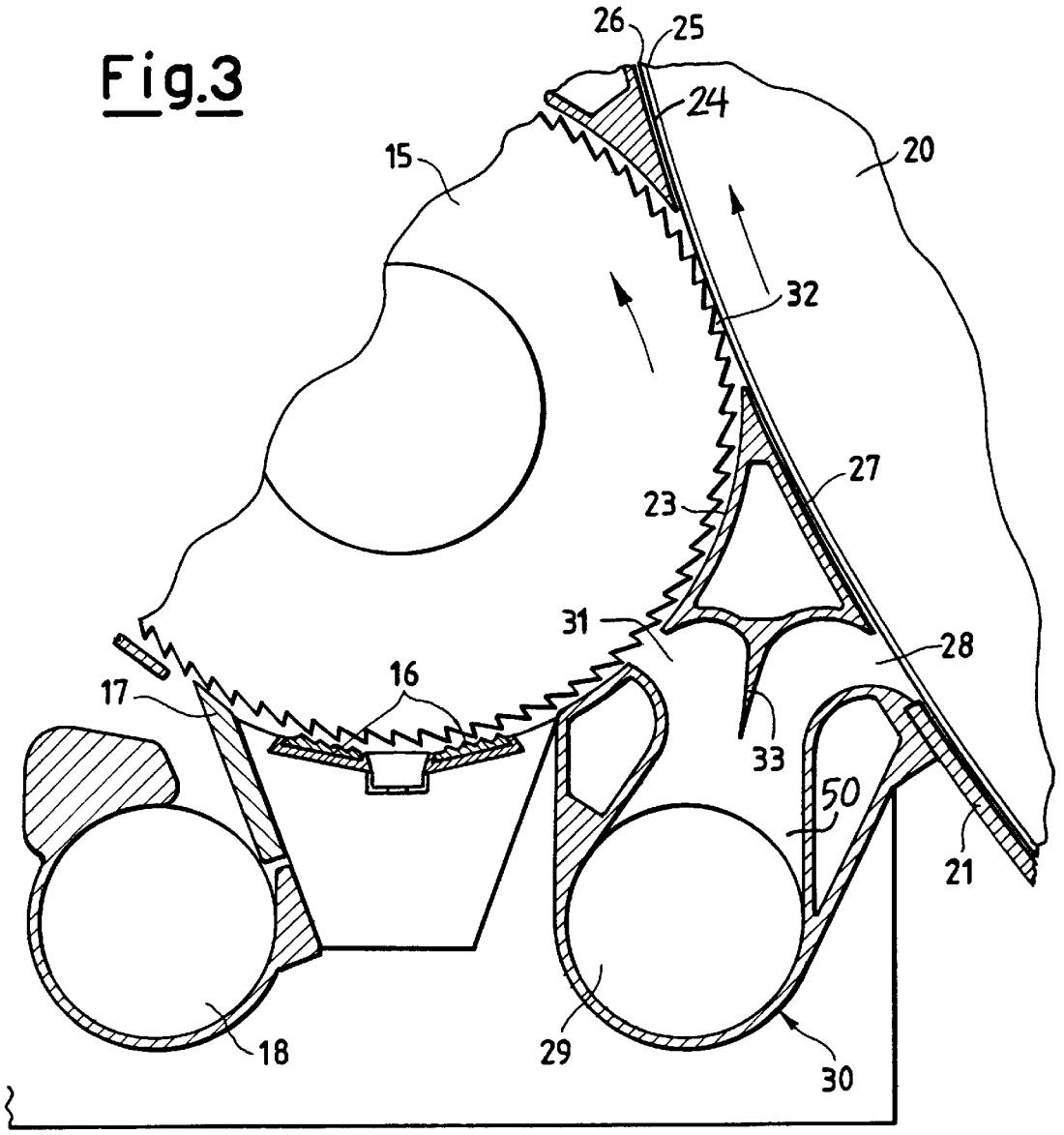
FIG. 3 is a further embodiment of FIG. 2 with a second tangential opening adjacent the feed roll with an increasing cross sectional area.

FIG. 3 shows an embodiment of a further improvement of the invention. In the body of the fiber-guiding wedge 30, equipped—like the wedge 22 in FIG. 2—with a discharge opening 28 for the air entrained in the annular interspace between the drum and the plate and the aspirating nozzle 29, the hollow face 23 surrounding the briseur 15 and preceding the confluence of the fibers is provided with a second tangential discharge opening 31 in the annular interspace for the air flowing between the briseur 15 and the hollow face 23 of the deviating wedge.

This opening 31 is also shaped in the body of the wedge to as to have a smoothly fitting tangential profile with an increasing cross-section in the direction toward the aspirating nozzle 29. The opening 31 also allows discharging part of the entrained air as a result of the rotation of the briseur 15, thus freeing the remaining portion of the annular interspace around the briseur and up to the point of confluence of the fibers from any turbulent effects, and further equalizing the pressures between the two annuli joining in the curved segment 32, where the transferring of the fibers occurs. According to a preferred embodiment of the invention, the distance of this opening 31 from the tip of the wedge 30 is held in the range of 50–100 mm, and preferably in the range of 70–80 mm.

The profile 33 collecting the air flows originating from the openings 28 and 31 extends within the wedge toward a nozzle 29, preferably up to the point of rendering the flows essentially parallel to each other, so as to contain the effects of turbulence induced by their confluence.

Figure 4:
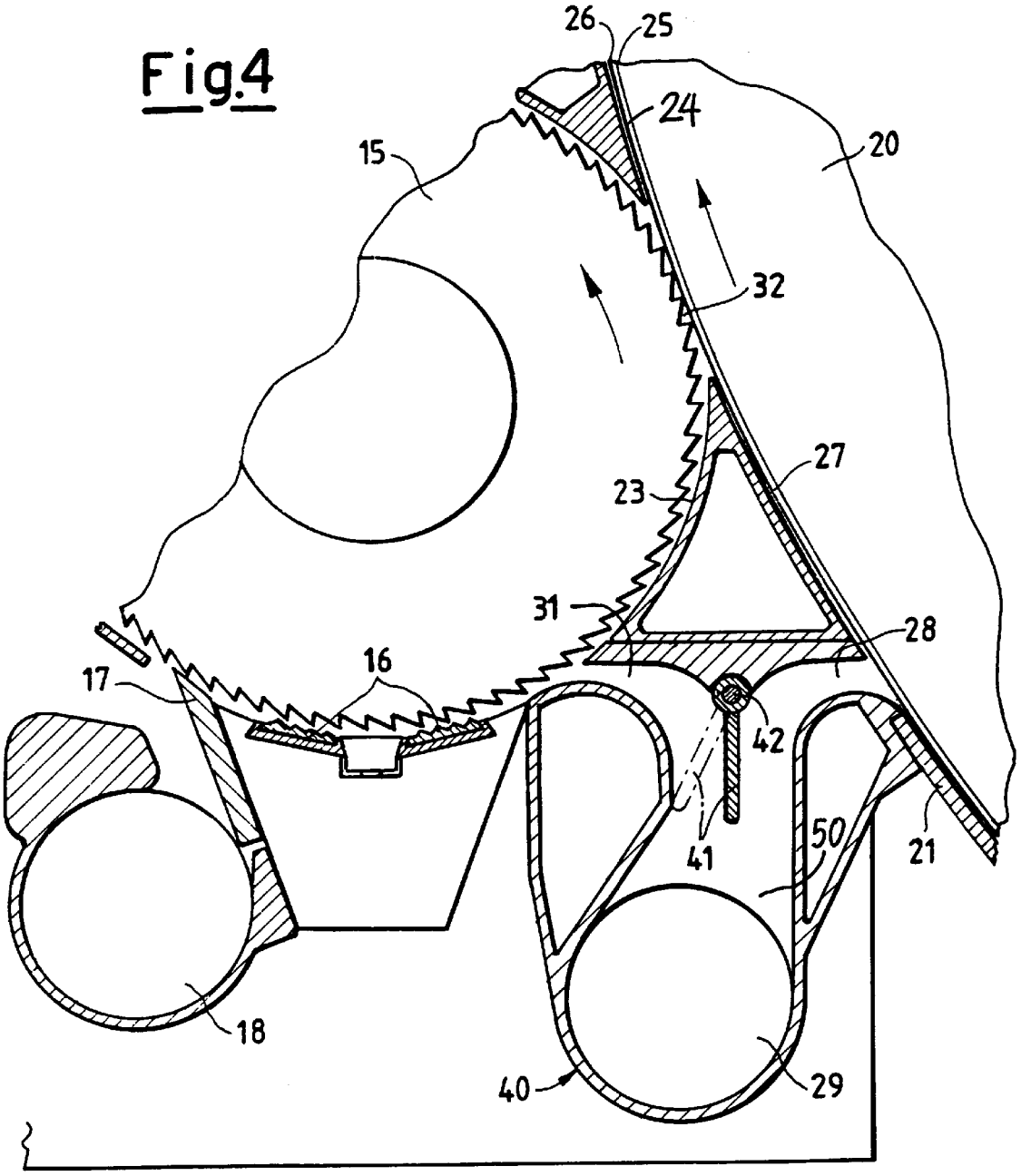
FIG. 4 is a further embodiment of FIG. 3 having a movable partition between both openings.

FIG. 4 shows a further embodiment of the invention in which the wedge 22 and the openings 28, 31 are constructed in two separated bodies. The openings are in fact provided in a body 40 which is attached in an adjustable manner below the wedge 22 and also contains the aspirating nozzle 29.

FIG. 4 shows a further feature of the embodiment, which may also be utilized in the case of a monolithic wedge structure, as shown for example in FIG. 3. According to this feature, the terminal part of the profile joining the flows originating from the openings 28, 31 is fitted with a mobile partition 41, which allows intercepting or partially choking the cross-section of the opening 31 leading to the briseur 15. This partition is hinged in 42 and can be operated by conventional means not shown in the Figure.

This invention allows considerable savings in the carding process. The transfer of the fibers between the briseur cylinder and the drum occurs in a far more uniform manner and with a lesser quantity of fibers detached by air turbulence. The distribution of the fibers on the drum trimming is more even and their parallel layout in the direction of the process is greatly enhanced.

We claim:

1. A flat carding machine comprising:

at least one feed roll;

a main carding drum; and a fiber-guiding wedge disposed in a tangent area between the at least one feed roll and the main carding drum, wherein the at least one feed roll feeds the main carding drum with fiber, the fiber being at least partially distributed and purified in a layer, and wherein the fiber-guiding wedge includes a channel having a first discharge opening at one end of the channel and an aspirating nozzle at an opposite end of the channel, the channel having a smooth tangential profile and an increasing cross-sectional area in a direction towards the aspirating nozzle.

2. The flat carding machine of claim 1, wherein the first discharge opening is disposed across substantially an entire width of the main carding drum.

3. The flat carding machine of claim 1, wherein the channel is held under negative pressure.

4. The flat carding machine of claim 1, wherein a distance from the main carding drum to a tip of the fiber-guiding wedge is between about 50 mm and about 100 mm.

5. The flat carding machine of claim 1, wherein a distance from the main carding drum to a tip of the fiber-guiding wedge is between about 80 mm and about 90 mm.

6. The flat carding machine of claim 1, wherein the fiber-guiding wedge further includes a second tangential discharge opening, the second tangential discharge opening being disposed in an annular interspace between the at least one feed roll and a hollow face of the fiber-guiding wedge.

7. The flat carding machine of claim 6, wherein a distance between the second tangential discharge opening and a tip of the fiber-guiding wedge is between about 50 mm and about 100 mm.

8. The flat carding machine of claim 7, wherein the distance between the second tangential discharge opening and a tip of the fiber-guiding wedge is between about 70 mm and about 80 mm.

9. The flat carding machine of claim 6, wherein the fiber guiding wedge further includes a movable partition for selectively adjusting a cross-sectional area of the second tangential discharge opening.

10. The flat carding machine according to claim 1, wherein an atmospheric pressure in a region of the aspiration nozzle is between about minus 20.0 mm $H_2O$ and about minus 60 mm $H_2O$.

11. The flat carding machine according to claim 1, wherein the channel is disposed in a hollow face of the fiber-guiding wedge.

* * * * *